US008684589B2

(12) United States Patent
Hisayasu et al.

(10) Patent No.: US 8,684,589 B2
(45) Date of Patent: Apr. 1, 2014

(54) LIGHTING DEVICE

(75) Inventors: Takeshi Hisayasu, Yokosuka (JP); Shinji Nakata, Yokosuka (JP); Hiroshi Kubota, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 13/607,996

(22) Filed: Sep. 10, 2012

(65) Prior Publication Data

US 2013/0107521 A1 May 2, 2013

(30) Foreign Application Priority Data

Oct. 27, 2011 (JP) ..... 2011-236132

(51) Int. Cl.
*H01R 33/00* (2006.01)
*F21V 29/00* (2006.01)

(52) U.S. Cl.
USPC ..... 362/646; 362/650; 362/373

(58) Field of Classification Search
USPC ..... 362/294, 373, 249.02, 647, 649, 650, 362/235, 646; 313/45–46, 313.04, 318.12, 313/498, 512
See application file for complete search history.

(56) References Cited

U.S. PATENT DOCUMENTS

| | | | | |
|---|---|---|---|---|
| 2009/0195186 | A1* | 8/2009 | Guest et al. | 315/294 |
| 2010/0237761 | A1* | 9/2010 | Osawa et al. | 313/46 |
| 2011/0095690 | A1 | 4/2011 | Sagal | |
| 2011/0101861 | A1 | 5/2011 | Yoo | |
| 2011/0110107 | A1* | 5/2011 | Kawato | 362/373 |

FOREIGN PATENT DOCUMENTS

JP 2006-313727 A 11/2006

OTHER PUBLICATIONS

Search Report received in corresponding European Patent Application No. 12183700.9, dated Dec. 4, 2012.

* cited by examiner

*Primary Examiner* — Thomas Sember
(74) *Attorney, Agent, or Firm* — Banner & Witcoff, Ltd.

(57) ABSTRACT

According to one embodiment, an LED lamp includes a housing, a base, an LED module, an LED lighting circuit board, and a globe. The base is attached to one end of the housing, and is supplied with electric power. The LED module is attached to the other end of the housing, and is equipped with LEDs. The LED lighting circuit board is accommodated in the housing, and the LED lighting circuit board is equipped with a lighting circuit. The globe covers the LEDs, and diffuses and radiates light emitted from the LEDs, and is attached to the housing. The housing is formed of resin having high thermal conductivity containing carbon-based filler. The light emitting module is attached to the housing through a heat transfer plate a part of which is exposed from the housing.

6 Claims, 12 Drawing Sheets

II a-II b

I a- I b

Ⅱa-Ⅱb

LIGHTING DEVICE

CROSS-REFERENCE TO RELATED APPLICATIONS

This application is based upon and claims the benefit of priority from Japanese Patent Application No. 2011-236132, filed on Oct. 27, 2011; the entire contents of which are incorporated herein by reference.

FIELD

Embodiments described herein relate generally to a lighting device having a light emitting element such as an LED (Light Emitting Diode), organic EL (Electro Luminescence), as a light source.

BACKGROUND

In the related art, in a lighting device using the LED as the light source, since a light emitting efficiency thereof is decreased when a temperature of the LED is increased, a metal housing with high thermal conductivity such as aluminum, aluminum die-casting, or the like is used in order to improve a heat radiation effect.

Metal such as aluminum or the like has high thermal conductivity, and has high conductivity, as well. For this reason, there is a concern that the number of components may increase, and a structure thereof may be complicated, since it is necessary to insulate between a base and the housing.

DETAILED DESCRIPTION

Figure 1:
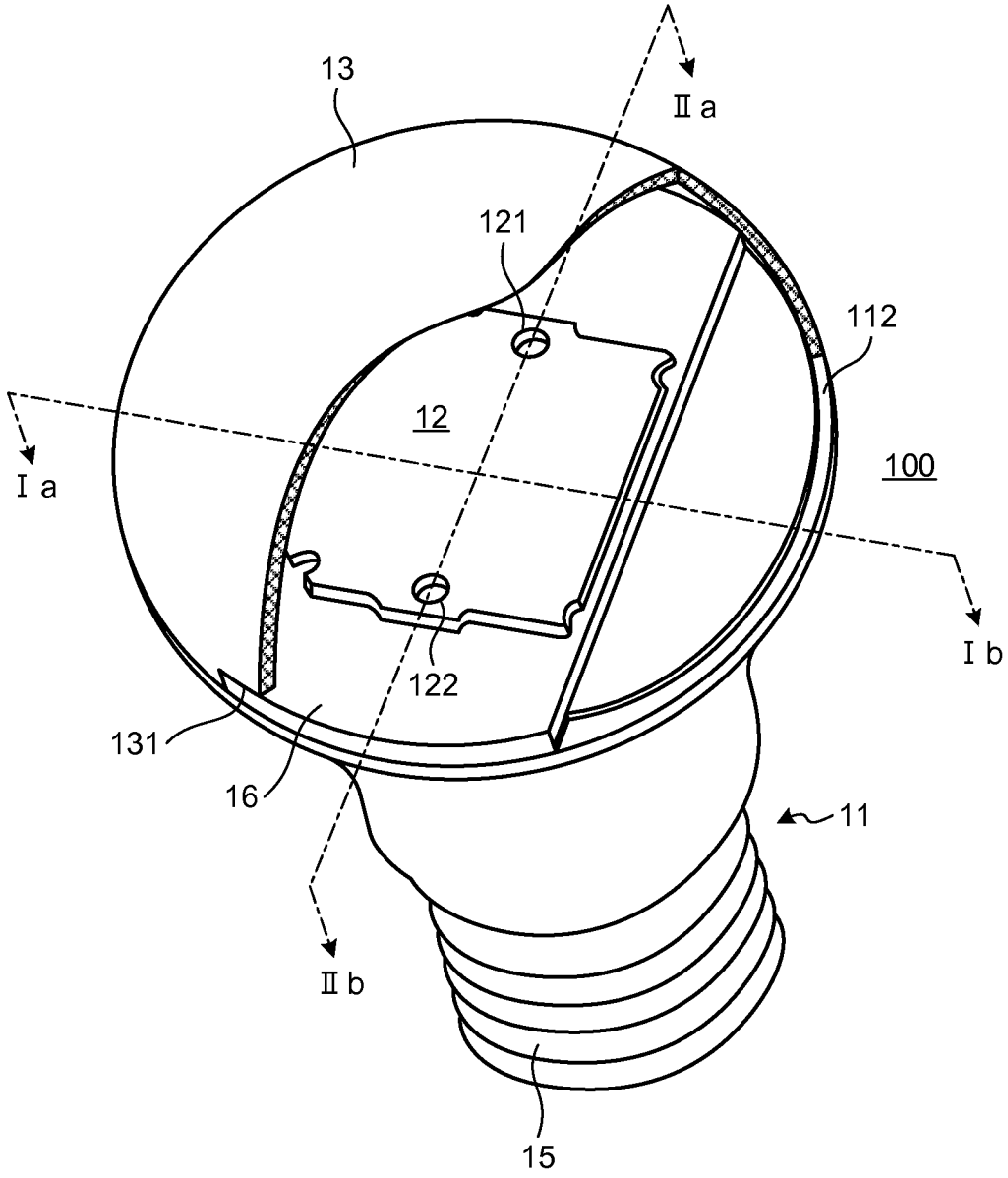
FIG. 1 is a perspective view which describes a lighting device according to a first embodiment.

An LED lamp 100 according to embodiments to be described below includes a housing 11, a base 15 which is attached to one end of the housing 11, and is supplied with electric power, an LED module 12 which is attached to the other end of the housing 11, and is equipped with LEDs, an LED lighting circuit board 14 which is accommodated in the housing 11, an input side of which is connected to the base 15, and an output side of which is connected to the LED module 12, and which is equipped with a lighting circuit which lights the LEDs in the LED module 12, and a translucent globe 13 which covers the LEDs, and which diffuses and radiates light emitted from the LEDs, and is attached to the housing 11. The housing 11 is formed of resin containing a carbon-based filler and having thermal conductivity, and the LED module 12 is attached to the housing 11 through a heat transfer plate 16 a part of which is exposed from the housing 11.

In addition, in the LED lamp 100 according to the embodiment, the housing 11 is formed of resin having thermal conductivity of 5 W/m·K or more.

In addition, in the LED lamp 100 according to the embodiment, the housing 11 is formed of PPS (polyphenylene sulfide) resin.

In addition, in the LED lamp 100 according to the embodiment, the heat transfer plate 16 has the same size as the other side of the housing 11 to which the LED module 12 is attached, and the entire side surface is exposed from the housing 11.

In addition, in the LED lamp 100 according to the embodiment, the housing 11 is formed by an accommodating unit 111 which is extended inside, and accommodates the LED lighting circuit board 14 at one end side, and a notch portion 114, or an open hole which communicates with the accommodating unit 111 at the side surface of the one end side. In the LED lighting circuit board 14 of the LED lamp, an external connection terminal 171 on one side to which the power is supplied is connected to an eyelet 153 of the base 15 through an opening at one end of the housing 11, and an external connection terminal 172 on the other side is connected to the base 15 through the notch portion 114, or the open hole which is formed at the side surface of the housing 11.

In addition, in the LED lamp 100 according to the embodiment, the housing 11 includes a screw unit 116 to be screwed to an electric bulb socket at one end side, and a base 15*a* is formed by being subject to plating on the surface of the screw unit 116.

Hereinafter, the lighting device according to the embodiment will be described with reference to drawings.

First Embodiment

Figure 2:
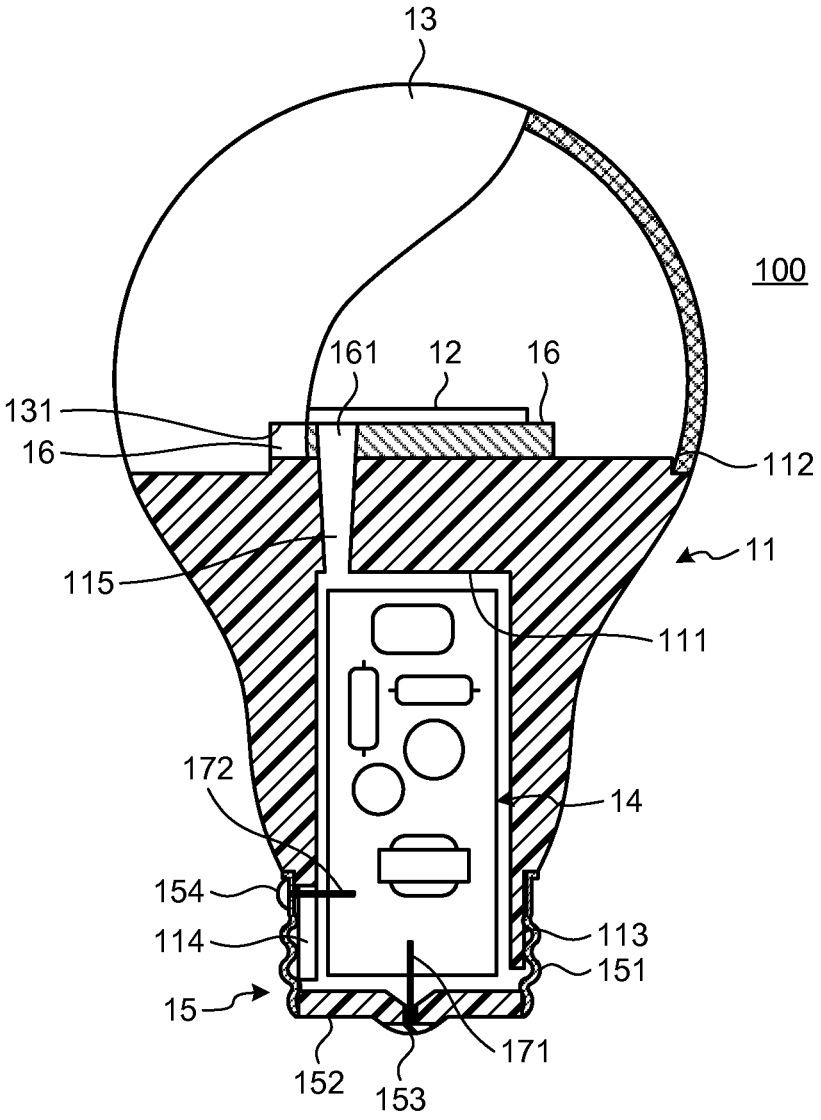
FIG. 2 is a cross-sectional view taken along line Ia-Ib in FIG. 1.
Figure 3:
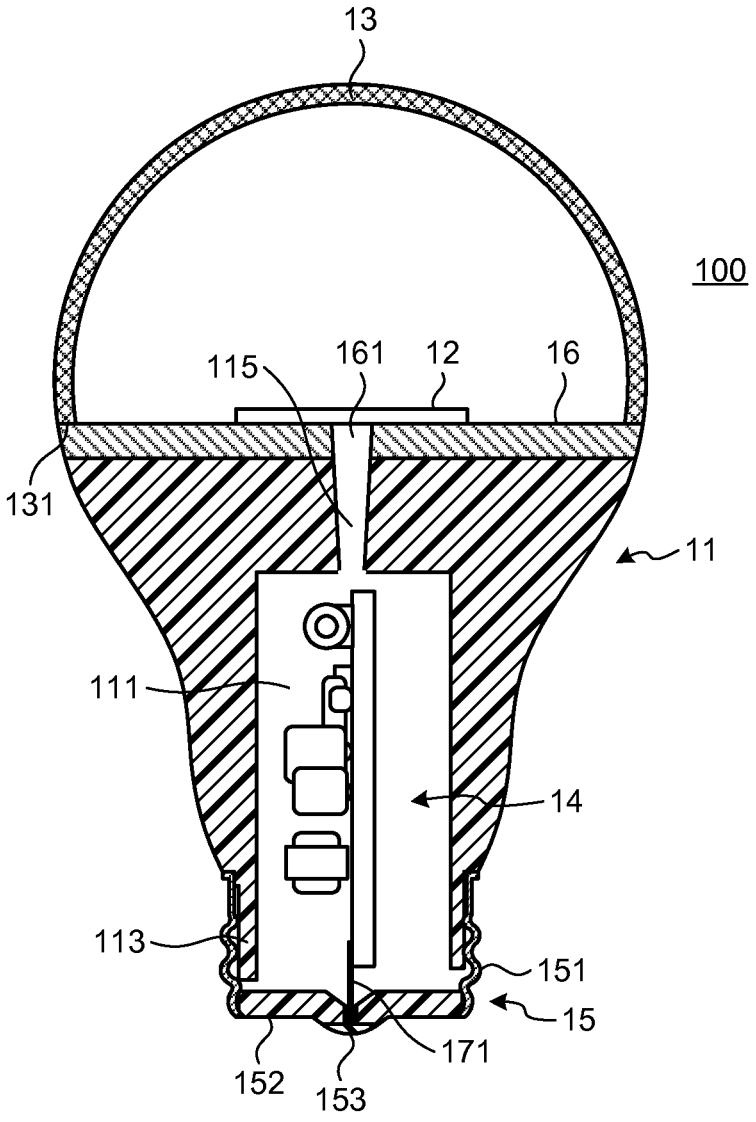
FIG. 3 is a cross-sectional view taken along line IIa-IIb in FIG. 1.
Figure 4:
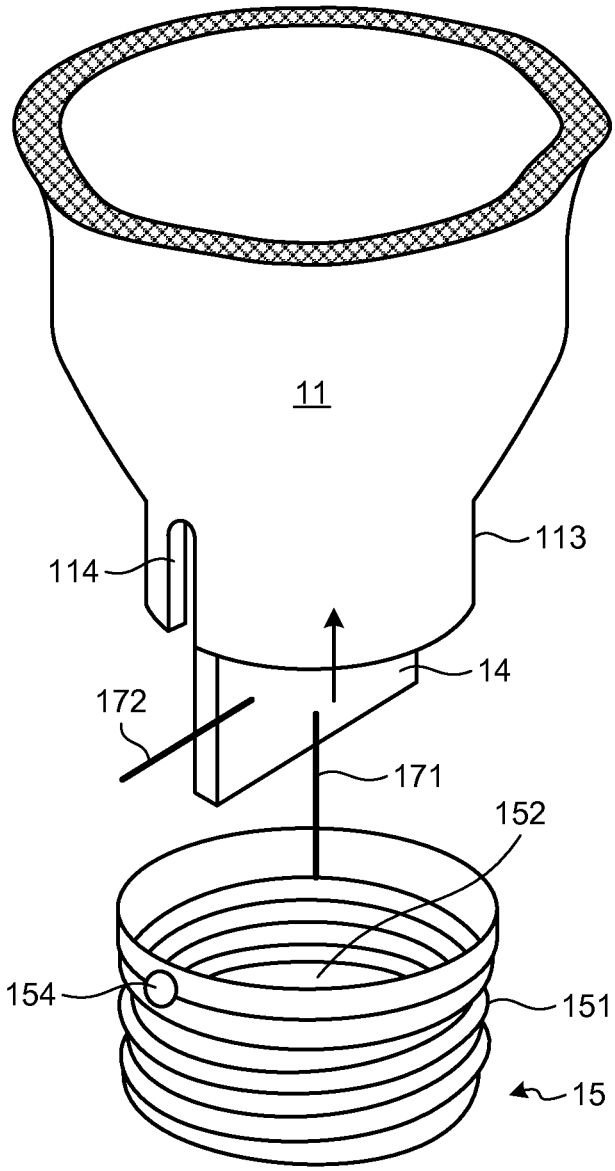
FIG. 4 is an exploded perspective view which shows a main part of FIG. 1.

FIGS. 1 to 4 are diagrams which show a first embodiment relating to the lighting device. FIG. 1 is a perspective view which shows a light bulb-type LED lamp by cutting out a part thereof. FIG. 2 is a cross-sectional view taken along line Ia-Ib of FIG. 1. FIG. 3 is a cross-sectional view taken along line IIa-IIb of FIG. 1. FIG. 4 is an exploded perspective view which shows a main part of FIG. 1.

As shown in FIGS. 1 to 3, the LED lamp 100 is the light bulb-type LED lamp of 40 W, 60 W, or the like. The LED lamp 100 includes a housing 11 which is formed using resin with high thermal conductivity. An accommodating unit 111 which extends inside is formed at one end side of the housing 11. A flange for attaching 112 which is provided with a step at the periphery thereof is formed at the other end side of the housing 11. In addition, an LED module 12 in which a plurality of LEDs as an example of a semiconductor light emitting element is mounted, and which is modularized is attached to the inside of the flange 112. The LED module 12 is covered and protected by a translucent globe 13 which is attached to the flange 112. A guide unit which is not shown is formed on the inner wall of the accommodating unit 111. By fitting an LED lighting circuit board 14 into the guide unit, the LED lighting circuit board 14 is held in the accommodating unit 111.

The housing 11 has an approximate column shape of which a diameter gradually becomes large from one end side with a small diameter to which the base 15 is attached to the other end side to which the LED module 12 is attached. The LED lamp 100 may be integrally formed with a radiating fin at the outer peripheral surface of the housing 11 as necessary.

When LEDs which emit blue light are used as the LED which is used in the LED module 12, in the LED module 12, the LED is covered by resin (not shown) such as silicon, and a phosphor which mainly radiates yellow light as a complementary color of a blue color by being excited by the blue light which is emitted by the LED is mixed in the resin. In this manner, illumination light of white system is obtained from the LED module 12. Since it is possible to obtain a necessary luminous color by changing ingredients or the like of the phosphor, it is possible to prepare for an LED module which can emit a neutral white color, or an incandescent color in addition to a white color.

The LED module 12 is attached onto an aluminum heat transfer plate 16 which has a good heat transfer property, for example, which is subject to aluminum, or alumite (anodic oxide coating) processing, using an adhesive or the like with high thermal conductivity. The plate surface of the heat transfer plate 16 at the periphery of a portion to which the LED module 12 is attached is preferable to be subject to surface finishing having high reflectance so as to suppress absorption of light which is emitted from the LED. The heat transfer plate 16 is formed with a size in which a part thereof reaches a position of the outer peripheral surface of the housing 11, and the part is exposed from the housing 11. The LED module 12 is provided with through holes 121 and 122 for screwing the LED module 12 to the heat transfer plate 16 in the vicinity of sides facing each other. The LED module 12 is screwed to the heat transfer plate 16 by interposing a thermal conducting sheet (not shown) therebetween.

The globe 13 is formed in a spherical shell shape using glass with light diffusion properties, synthetic resin, or the like, and the outer peripheral surface of the globe 13 and the outer peripheral surface of the housing 11 are approximately flush with each other, by coming into contact with flange 112. In addition, the globe 13 is provided with a notch 131 for avoiding an interference by the heat transfer plate 16 which is arranged up to a position of the outer peripheral surface of the housing 11.

A base attaching portion 113 which has a small diameter in order to attach the base 15 thereto is formed at the outer periphery of an inlet zone of the accommodating unit 111. The base 15 is attached as a power connection unit for receiving a power supply by being electrically connected, and by being screwed to a socket of the counterpart which is not shown. The base 15 is fixed using caulking, or an adhesive with heat resistance such as silicon resin, epoxy resin, or the like.

Here, a configuration of the base 15 will be further described while referring to the exploded perspective view in FIG. 4, as well. In addition, an order of attaching the base 15 to the base attaching portion 113 will be described, as well.

Since the base 15 is an Edison type E26, the base 15 includes a cylindrical shell 151 with thread ridge for being screwed to a lamp socket of lighting equipment which is not shown, and an eyelet 153 which is provided through an insulating unit 152 at one end side of the shell 151. An external connection terminal 171 one end of which is connected to the eyelet 153, and which extends into the base 15 is attached to the base 15. In addition, an external connection terminal 172 which is formed in the vicinity of an opening end, of which one end is connected to a connection hole 154, and which is extended in the base 15 is attached to the base 15. The external connection terminals 171 and 172 are connected to a power supply unit of an LED lighting circuit which is configured on the LED lighting circuit board 14.

A notch portion 114 is formed on the base attaching portion 113 of the housing 11 from an opening end of the base attaching portion 113. The notch portion 114 has a role of accommodating the external connection terminal 172 when accommodating the LED lighting circuit board 14 in the accommodating unit 111 in the direction which is denoted by an arrow in FIG. 4 in a state where the base 15 and the LED lighting circuit board 14 are electrically and mechanically joined in the external connection terminals 171 and 172. In addition, silicon resin or the like as a filling material with a heat radiation property and an insulation property may be filled in the accommodating unit 111.

In addition, when attaching the base 15 to the base attaching portion 113, the LED lighting circuit board 14 is sled in a state of being engaged with the guide unit which is formed on the inner wall of the accommodating unit 111. In this manner, the base 15 is inserted and attached to the base attaching portion 113. In addition, the LED lighting circuit board 14 is held in the accommodating unit 111. In addition, as described above, the base 15 is fixed to the base attaching portion 113 using caulking, or an adhesive with heat resistance such as silicon resin, or epoxy resin.

In addition, a wiring hole 161 which communicates with an insertion hole portion 115 of the housing 11 is formed in the center portion of the LED module 12. The LED module 12 and the LED lighting circuit board 14 are electrically connected to each other using a not shown power line which passes through the insertion hole portion 115 and the wiring hole 161.

Figure 5:
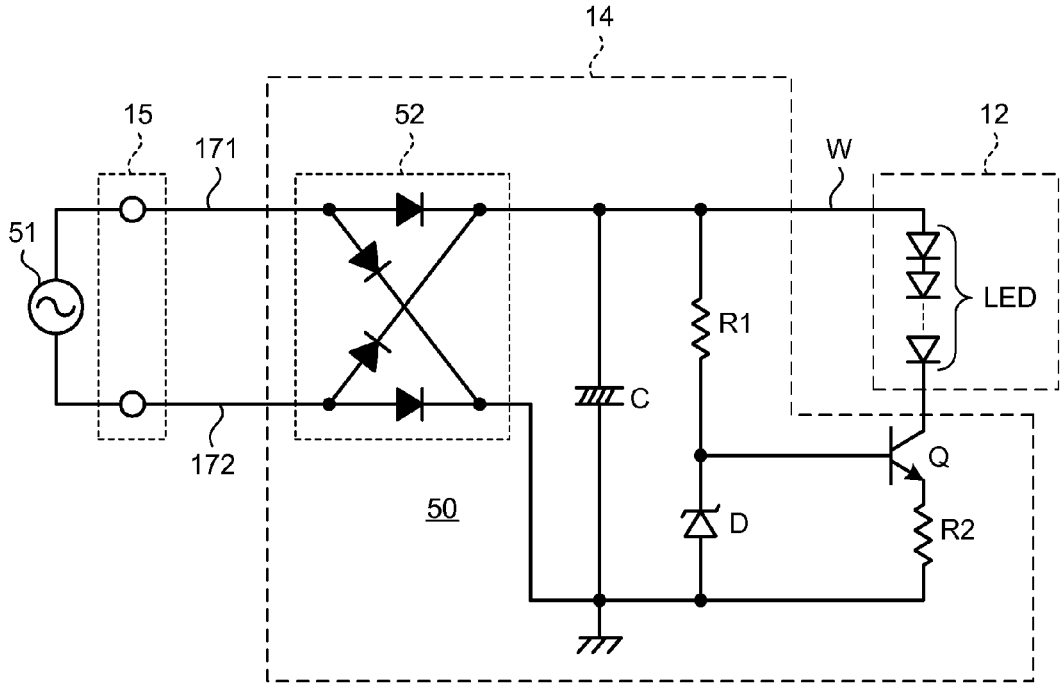
FIG. 5 is a circuit configuration diagram which describes an example of a lighting circuit which lights an LED according to the first embodiment.

FIG. 5 is a circuit configuration diagram which describes an example of an LED lighting circuit which is mounted in the LED lighting circuit board 14.

An LED lighting circuit 50 converts an AC voltage 100 V of a power supply 51 which is supplied from the base 15 through the external connection terminals 171 and 172 to, for example, a DC voltage 24 V by performing smoothing rectification using a diode bridge 52 and a smoothing capacitor C, and supplies thereof to each LED. R1 is a chip resistance which sets a current flowing in the LED of the LED module 12. Q is a transistor for controlling lighting of the LED. A base potential of the transistor Q is set by a chip resistance R2 and a Zener diode D.

In this manner, when the power supply 51 of the AC voltage 100 V is supplied to the LED lighting circuit 50, the AC voltage 100 V is converted to the DC voltage 24 V by the diode bridge 52 and the smoothing capacitor C, and a voltage which is set by the chip resistance R2 and the Zener diode D is applied to the LED module 12. The LED module 12 lights up each LED when the current which is controlled by the transistor Q flows. In addition, a dimming circuit which adjusts illuminance of the LED module 12 may be provided in the LED lighting circuit 50.

In addition, an output end of the LED lighting circuit 50 is connected with a power line W for supplying a power to the LED module 12. The power line W supplies the power to the LED of the LED module 12 from the LED lighting circuit board 14 which is provided in the above described accommodating unit 111 by being inserted through the insertion hole 115 and the wiring hole 161.

Meanwhile, in the housing 11, a resin material having high thermal conductivity of 5 W/m·K or more is used instead of the metal material having high thermal conductivity such as aluminum, or aluminum die-casting in the related art. As such a resin material, for example, PPS (polyphenylene sulfide) resin having thermal conductivity of 25 W/m·K is considered.

In addition, as the PPS resin having thermal conductivity of 25 W/m·K, technical contents thereof is introduced in "Resin with thermal conductivity of 60 times is developed/Metal component is replaced to cheap plastic" on p 127 to p 136 in a literature "Nikkei Electronics" which is published in Dec. 16, 2002 from Nikkei BP. Co. (Nikkei Business Publications, Inc.). By using at least the PPS resin as a material of the housing 11, the housing is practically used as the housing 11 which needs the thermal conductivity of 5 W/m·K or more. Further, the housing 11 is able to improve the thermal conductivity by including exothermic filler in the resin material. When considering the cost of the housing 11 with the insulation property, it is preferable to use exothermic filler of carbon system such as carbon, or graphite.

In this manner, the housing 11 is formed using a resin material including the exothermic filler of carbon system having the thermal conductivity of 5 W/m·K or more. Due to this, the housing can be practically used as the housing 11 of the LED module 12 which radiates high heat even in a case of forming the housing 11 using the resin material.

The base 15 can be directly attached to the base attaching portion 113 which is integrally formed with the housing 11. In addition, since the housing 11 has the insulation property, it is not necessary to adopt an insulating unit between the base 15 and the housing 11 even when the base 15 is directly attached to the base attaching portion 113, accordingly, it is also possible to reduce the number of components.

Further, the heat transfer plate 16 is able to suppress the absorption of light which is emitted from the LED of the LED module 12 by having a board, for example, which is formed of a metal material such as aluminum, or an insulating material, or a board with high reflectance, for example a board of a white system, and to effectively radiate the light which is emitted from the LED of the LED module 12 through the globe 13.

According to the embodiment, by forming the housing using resin with high thermal conductivity, it is possible to realize the configuration of the LED lamp using a cheap material. In addition, since it is possible to attach the base and the LED module to a common housing, it is possible to reduce assembling processes, and to realize a cheap LED lamp by simplifying the entire configuration.

Further, the LED module 12 is attached onto the housing using the resin with high thermal conductivity through the aluminum based-heat transfer plate with high thermal conductivity, and a part thereof is exposed to the outside of the housing made by resin with high thermal conductivity. For this reason, the heat emitted from the LED module is radiated to the outside from the exposed portion through the heat transfer plate with high thermal conductivity, and it is possible to improve the radiation effect of the housing made by resin.

Second Embodiment

Figure 6:
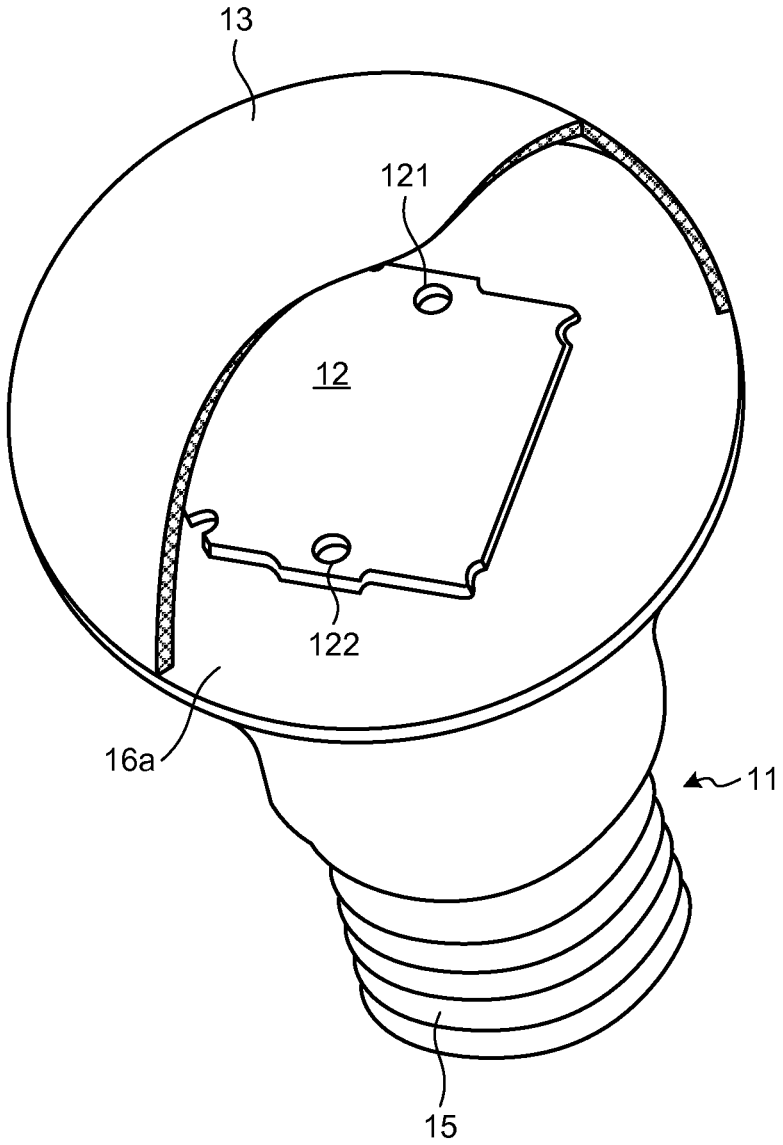
FIG. 6 is a perspective view which describes a lighting device according to a second embodiment.
Figure 7:
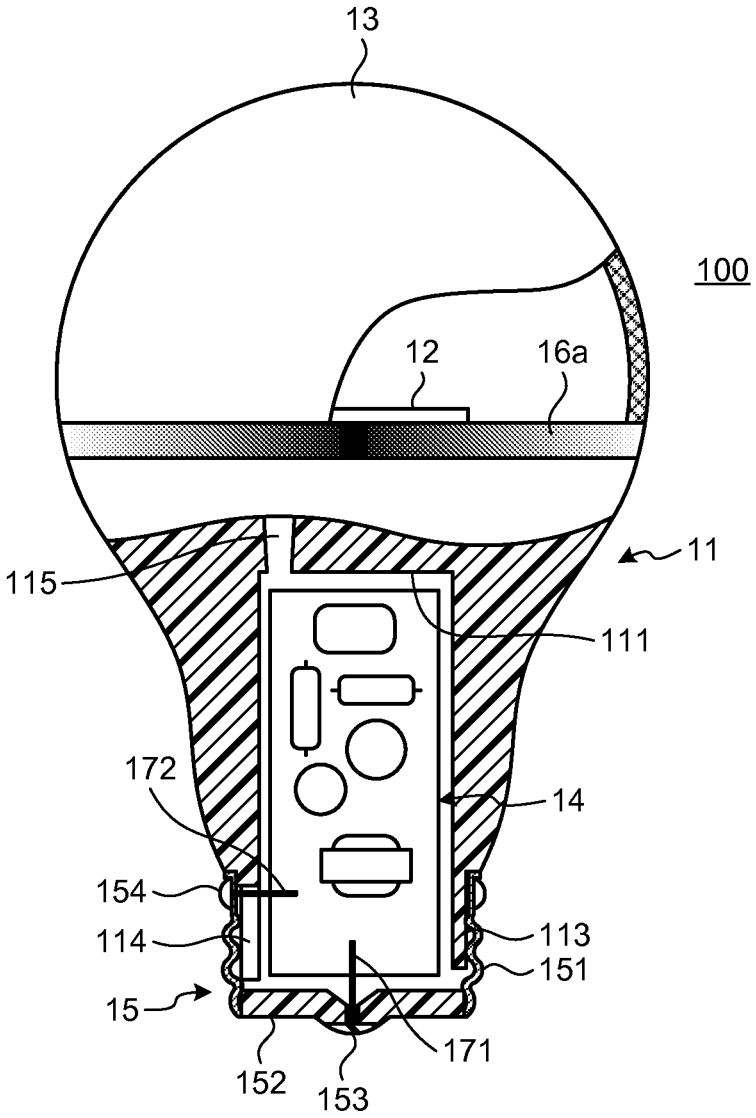
FIG. 7 is a cross-sectional view corresponding to FIG. 2 of the lighting device according to the second embodiment.

FIGS. 6 and 7 show a lighting device according to a second embodiment. FIG. 6 is a perspective view which shows a light bulb-type LED lamp by cutting out a part thereof. FIG. 7 is a vertical cross-sectional view of an LED module in a state of being covered by a globe. In addition, in each embodiment described in below, the same constituent portions as the above described embodiment will be given with the same reference numerals, and mainly different portions will be described here.

According to the embodiment, it is set such that a heat transfer plate 16*a* with the same size as that of the surface on the other end side to which an LED module 12 is attached is set, and the entire side surface of the heat transfer plate 16*a* is exposed from a globe 13.

In this manner, in an LED lamp 100, it is possible to improve a radiation effect by increasing an exposing area of the heat transfer plate 16*a*, in addition to the effect in the first embodiment. In this case, attaching of the globe 13 may be performed such that an opening end of the globe 13 is directly attached to the heat transfer plate 16*a* using an adhesive, however, the attaching may be also performed such that an annular protrusion is formed at the heat transfer plate 16*a*, the opening end of the globe is fitted into the protrusion, and then attaching is performed using an adhesive. Further, the globe 13 may be fixed to the annular protrusion by performing screwing with respect to the annular protrusion from the globe 13, in a state where the outer peripheral side surface of the annular protrusion and the inner peripheral surface of the globe 13 are fitted to each other. Alternatively, it may have a configuration in which a plurality of claws is integrally formed, having appropriate intervals in an annulation in the vicinity of the outer peripheral of a housing 11 facing the heat transfer plate 16*a*, the claws are exposed to the surface of the heat transfer plate 16*a* through a through hole which is open to the heat transfer plate 16*a*, and the claws are engaged with an engaging portion which is formed in the globe 13.

Third Embodiment

Figure 8:
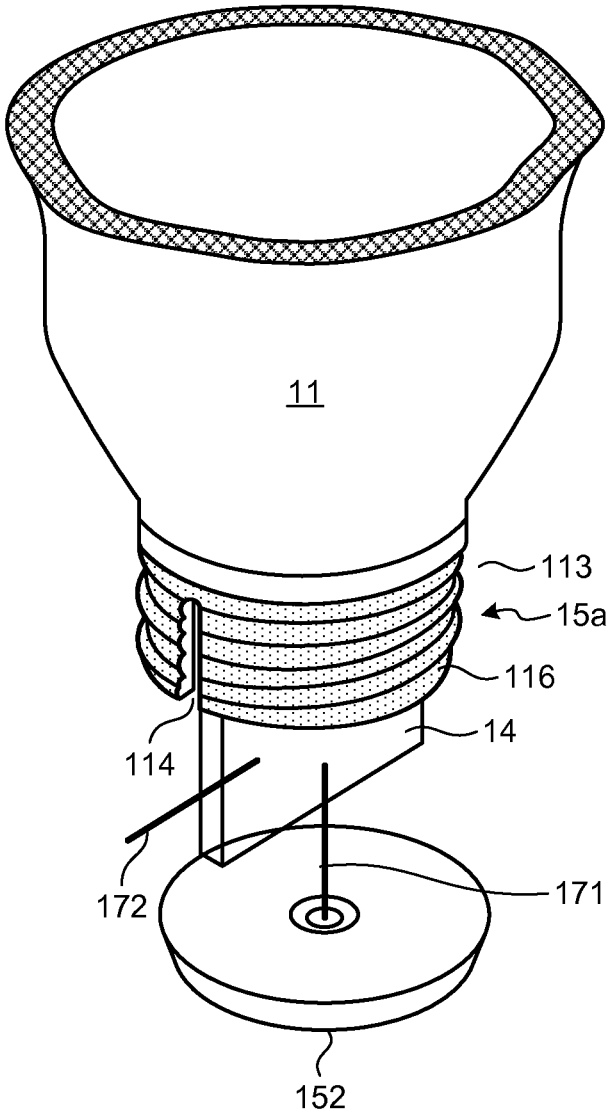
FIG. 8 is a perspective view which describes the lighting device according to the second embodiment.
Figure 9:
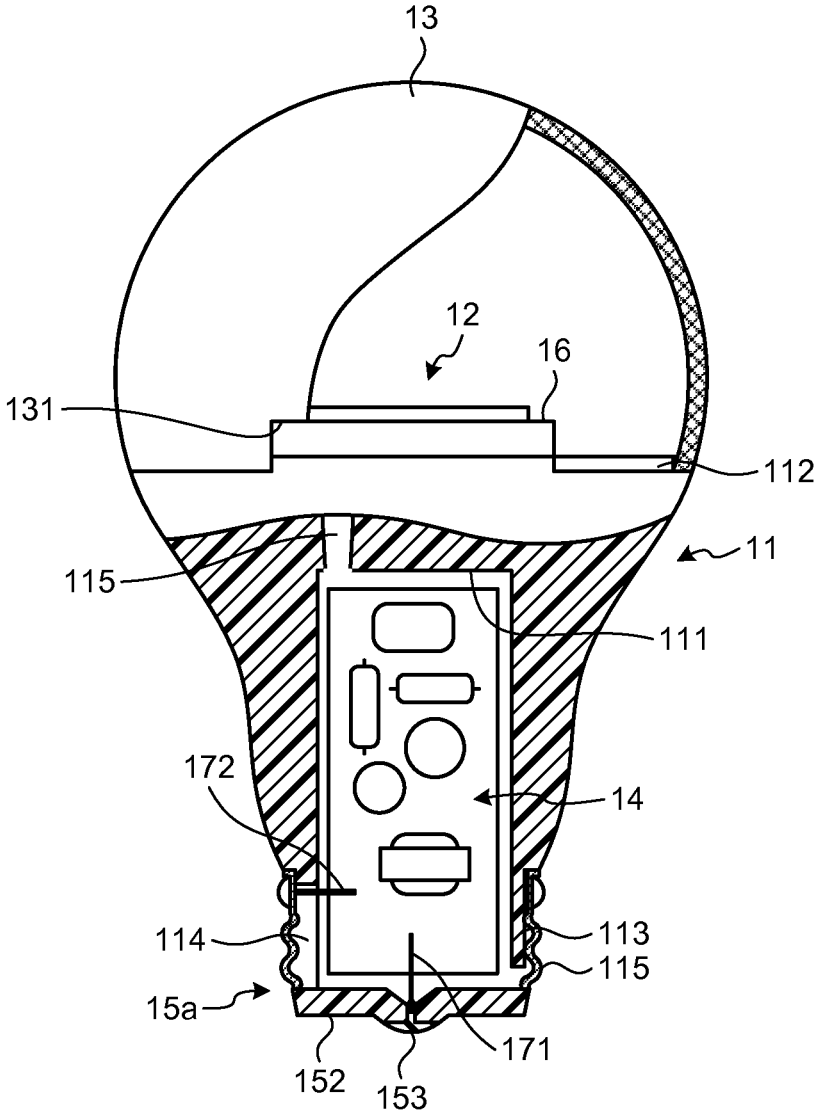
FIG. 9 is a cross-sectional view corresponding to FIG. 2 of a lighting device according to a third embodiment.

FIGS. 8 and 9 are diagrams which show a lighting device according to a third embodiment. FIG. 8 is a perspective view which shows a main part of a light bulb-type LED lamp. FIG. 9 is a cross-sectional view corresponding to FIG. 2 in a state where a light emitting unit is covered by a globe.

According to the embodiment, a screw unit 116 for being screwed to a light bulb socket (not shown) is integrally formed at the outer peripheral surface of a base attaching portion 113 of a housing 11. Plating is performed on the surface of the screw unit 116, and a base 15*a* is formed.

In addition, an end of an external connection terminal 171 is connected to an eyelet 153 which is fixed to an insulation unit 152. The other end of the external connection terminal 171 is connected to an LED lighting circuit board 14. One end of an external connection terminal 172 is connected to the LED lighting circuit board 14. The other end of the external connection terminal 172 is connected at a position where the insulation unit 152 comes into contact with an opening end of the base attaching portion 113 by being welded with a base 15*a* by moving a notch portion 114 at the time of accommodating the LED lighting circuit board 14 in an accommodating unit 111. In addition, the insulation unit 152 and the opening end of the base attaching portion 113 are fixed to each other using an adhesive.

According to the embodiment, since the base is formed at the screw unit which is integrally formed with the housing using plating, it is possible to contribute to cost down of the LED lamp by reducing a time of processing of attaching the base, and a time of processing the base itself.

According to the embodiments, the lighting device is not limited to the above descriptions. For example, a case of the LED module on which the LEDs as the light emitting element are mounted is described, however, other light emitting elements such as an organic El may be used, as well.

In the above described each embodiment, the thin and long notch portion 114 is formed from the opening end of the base attaching portion 113 in order to attach the external connection terminal 172 to the LED lighting circuit board 14, however, it may be an open hole. In this case, the external connection terminal 172 may be welded with the base in a state where one end thereof is connected to the LED lighting circuit board 14, and then the other end is inserted to the open hole.

Figure 10:
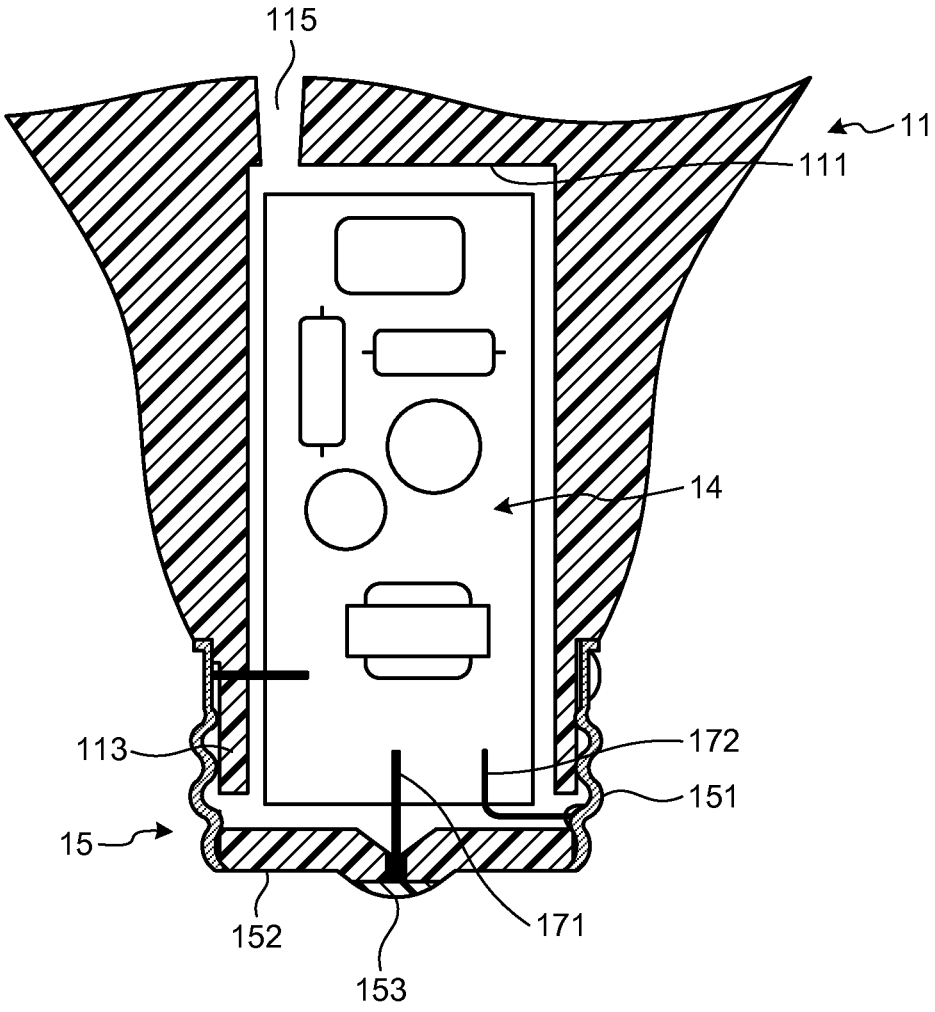
FIG. 10 is an explanatory diagram which describes a modification example of a base.

In addition, in the cases of the first and the second embodiments, as shown in FIG. 10, one end of the external connection terminal 172 is welded with the base 15 by inserting the one end into the open hole which is open to the base 15 in the vicinity of the insulation unit 152, and the other end is connected to the LED lighting circuit board 14 through the opening end of the base attaching portion 113. In this case, it is not necessary to form the thin and long notch portion 114 through which the external connection terminal 172 passes, or the open hole in the base attaching portion 113.

Figure 11:
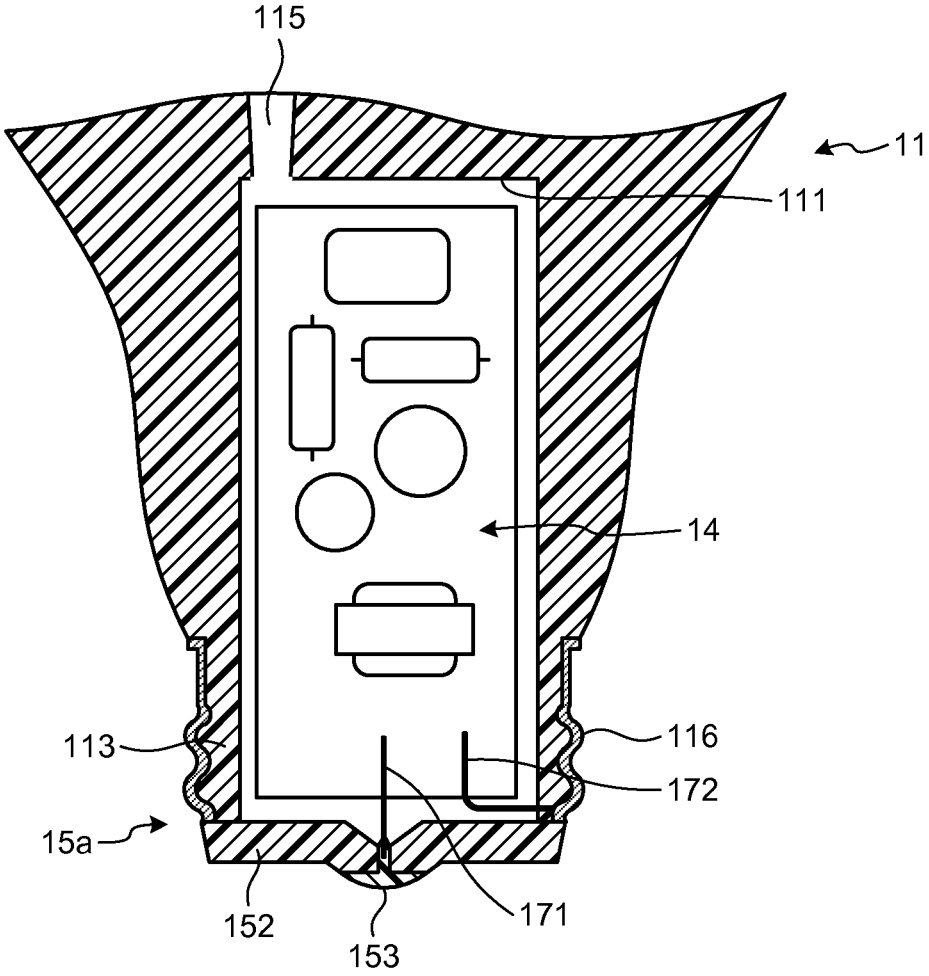
FIG. 11 is an explanatory diagram which describes a modification example of a base.

Further, in a case of the third embodiment, as shown in FIG. 11, one end of the external connection terminal 172 is welded with the base 15*a* which is formed using plating between the opening end of the base attaching portion 113 and the insulation unit 152, and the other end is electrically connected to the LED lighting circuit board 14. In this case, it is not necessary to form the thin and long notch portion 114 through which the external connection terminal 172 passes, or the open hole, as well, in the base attaching portion 113. In addition, in this case, it is possible to omit the open hole even in the base 15*a*.

Figure 12:
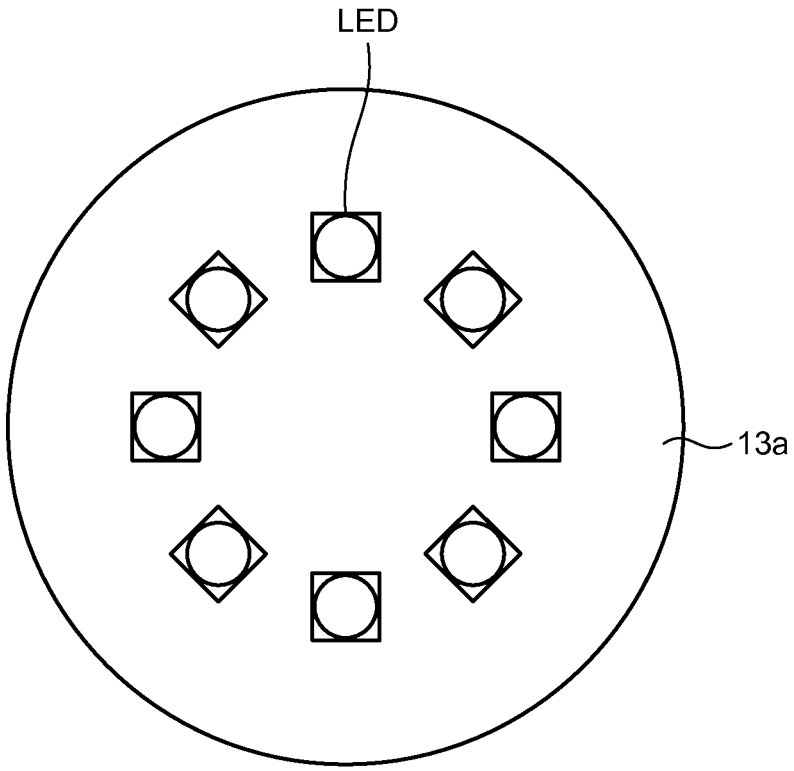
FIG. 12 is an explanatory diagram which describes another example of an LED module.

In addition, as shown in FIG. 12, the LED module may be configured such that the plurality of LEDs is arranged in an annular shape at even intervals on a substrate 13*a* having high thermal conductivity. In this configuration, eight LEDs are arranged, however, the number of LEDs is not limited to this, and the numbers can be changed according to a specification, or a usage of the lighting device, or the arrangement can be appropriately performed in a shape of approximate rectangle, or the like.

Although several embodiments and the examples of the invention have been described, these embodiments or the examples are presented as examples and are not intended to limit the scope of the invention. These novel embodiments or examples may be implemented in other various modes, and various omissions, replacements, combinations and modifications may be made without departing the scope of the invention. The embodiments or examples and the modifications thereof are included in the scope and gist of the invention, and are included in a scope equivalent to the invention described in the Claims.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting device comprising:

a housing;

a base which is attached to one end of the housing, and is configured to receive electric power;

a heat transfer plate which is attached to another end of the housing, and extends to a position corresponding to an outer peripheral surface of the housing;

a light emitting module which is attached to a first surface of the heat transfer plate opposite to a second surface of the heat transfer plate on which the housing is attached, the light emitting module being equipped with light emitting elements;

a lighting circuit board which is accommodated in the housing, an input side of the lighting circuit board being connected to the base, and an output side of the lighting circuit board being connected to the light emitting elements, wherein the lighting circuit board is equipped with a lighting circuit configured to illuminate the light emitting elements; and a translucent globe which covers the light emitting elements, and configured to diffuse and radiate light emitted from the light emitting elements, the translucent globe configured to be attached to the housing, wherein the housing is formed of resin containing a carbon-based filler and having thermal conductivity, wherein the heat transfer plate is disposed between the housing and the globe, and wherein a side of the heat transfer plate is exposed from the housing and the globe.

2. The device according to claim 1, wherein the housing is formed of a resin material having thermal conductivity of 5 W/m·K or more.

3. The device according to claim 2, wherein the housing is formed of PPS (polyphenylene sulfide) resin.

4. The device according to claim 1, wherein the heat transfer plate has the same size as the other side of the housing to which the light emitting module is attached, and the entire side surface of the heat transfer plate is exposed from the housing.

5. The device according to claim 1, wherein the housing is provided with an accommodating unit which extends to an internal portion thereof and accommodates the lighting circuit board at one end side, and is provided with a communication unit which communicates with the accommodating unit at a side surface of the one end side, and wherein, in the lighting circuit board, one external connection terminal thereof to which the electric power is supplied is connected to an eyelet of the base through an opening at one end of the housing, and the other external connection terminal thereof is connected to the base through the communication unit which is formed on the side surface of the housing.

6. The device according to claim 1, wherein the housing is formed with a screw unit configured to be screwably-inserted to an electric bulb socket at one end side, and wherein the base is formed by performing plating on a surface of the screw unit.

* * * * *